US011476610B2

(12) United States Patent
Ahldag

(10) Patent No.: US 11,476,610 B2
(45) Date of Patent: Oct. 18, 2022

(54) CONDUCTOR TERMINAL

(71) Applicant: WAGO Verwaltungsgesellschaft mbH, Minden (DE)

(72) Inventor: Joerg Ahldag, Rinteln (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/443,681

(22) Filed: Jul. 27, 2021

(65) Prior Publication Data

US 2022/0037822 A1 Feb. 3, 2022

(30) Foreign Application Priority Data

Jul. 28, 2020 (DE) ..... 10 2020 119 865.5

(51) Int. Cl.
*H01R 13/187* (2006.01)

(52) U.S. Cl.
CPC ..... *H01R 13/187* (2013.01)

(58) Field of Classification Search
CPC ..... H01R 13/187; H01R 13/18; H01R 13/17; H01R 13/15; H01R 13/02; H01R 13/00
USPC ..... 439/729
See application file for complete search history.

(56) References Cited

U.S. PATENT DOCUMENTS 6,270,384 B2 8/2001 Jang
6,689,955 B2 * 2/2004 Doutaz ..... H01R 4/5008 439/828
7,510,448 B2 * 3/2009 Eppe ..... H01R 4/4836 439/729
8,129,641 B2 * 3/2012 Majewski ..... H01R 4/4845 439/441
8,444,443 B2 * 5/2013 Schafmeister ..... H01R 4/4836 439/441
8,475,191 B2 * 7/2013 Schafmeister ..... H01R 4/4836 439/489

(Continued)

FOREIGN PATENT DOCUMENTS

CN 102969592 A 3/2013
DE 198 23 648 C1 11/1999

(Continued)

*Primary Examiner* — Harshad C Patel
(74) *Attorney, Agent, or Firm* — Muncy, Geissler, Olds & Lowe, P.C.

(57) ABSTRACT

A conductor terminal, including an insulating housing having a conductor insertion opening for inserting an electrical conductor in a conductor insertion direction, a busbar and a clamping spring. The clamping spring having a clamping leg, which, together with the busbar, forms a clamping point for the electrical conductor. An actuating element is movably supported in an actuating channel in the insulating housing and having an actuating section interacting with the clamping leg in such a way that the clamping leg is displaceably designed to open the clamping point during a movement of the actuating element in the direction of the clamping leg. The actuating element being transferable from an initial position into an actuating position, and the clamping point being opened in the actuating position. The actuating element being pivotably supported in a locking position in the actuating position, and being lockable in the locking position.

13 Claims, 6 Drawing Sheets

(56) References Cited

U.S. PATENT DOCUMENTS

| | | | | |
|---|---|---|---|---|
| 8,480,424 | B2 * | 7/2013 | Koellmann | H01R 4/4845 439/358 |
| 8,998,634 | B2 | 4/2015 | Koellmann | |
| 9,413,082 | B2 * | 8/2016 | Gassauer | H01R 4/4845 |
| 9,466,911 | B1 | 10/2016 | Wu | |
| 9,865,940 | B2 | 1/2018 | Sichmann et al. | |
| 10,193,245 | B2 * | 1/2019 | Lorenschat | H01R 4/4845 |
| 10,418,727 | B1 * | 9/2019 | Wu | H01R 4/4827 |
| 2011/0217882 | A1 * | 9/2011 | Gassauer | H01R 4/4836 439/729 |
| 2012/0238156 | A1 * | 9/2012 | Hayashi | H01R 4/4836 439/820 |
| 2013/0095688 | A1 * | 4/2013 | Koellmann | H01R 4/4845 439/358 |
| 2016/0319853 | A1 * | 11/2016 | Wu | F16B 2/22 |
| 2020/0176897 | A1 * | 6/2020 | Ober-Woerder | H01R 4/4827 |

FOREIGN PATENT DOCUMENTS

| | | | |
|---|---|---|---|
| DE | 10 2007 050 683 | B4 | 9/2009 |
| DE | 10 2008 039 232 | A1 | 2/2010 |
| DE | 20 2014 102 521 | U1 | 10/2015 |
| DE | 20 2016 105 826 | U1 | 3/2018 |
| DE | 202017106966 | U1 | 2/2019 |
| DE | 10 2017 127 001 | B3 | 3/2019 |
| WO | WO 2015/180950 | A1 | 12/2015 |

* cited by examiner

CONDUCTOR TERMINAL

This nonprovisional application claims priority under 35 U.S.C. § 119(a) to German Patent Application No. 10 2020 119 865.5, which was filed in Germany on Jul. 28, 2020 and which is herein incorporated by reference.

BACKGROUND OF THE INVENTION

Field of the Invention

The present invention relates to a conductor terminal, including insulating housing, the insulating housing having a conductor insertion opening for inserting an electrical conductor in a conductor insertion direction, including a busbar and including a clamping spring, the clamping spring having a clamping leg, which, together with the busbar, forms a clamping point for the electrical conductor, and including an actuating element, the actuating element being movably supported in an actuating channel in the insulating housing and having an actuating section, the actuating interacting with the clamping leg in such a way that the clamping leg is displaceably designed to open the clamping point during a movement of the actuating element in the direction of the clamping leg, the actuating element being transferable from an initial position into an actuating position, and the clamping point being opened in the actuating position, and the actuating element being pivotably supported in a locking position in the actuating position, and the actuating element being lockable in the locking position.

Description of the Background Art

DE 10 2017 127 001 B3 discloses a conductor terminal, including an actuating element, the actuating element being arranged in an actuating channel. The actuating element may lock behind a locking shoulder in an actuating position when the clamping point is open. The pivoting into the locking shoulder takes place actively by the user.

SUMMARY OF THE INVENTION

It is therefore an object of the present invention to provide an improved conductor terminal.

In the case of a generic conductor terminal, it is proposed that an elastically deflectable spring lug is arranged on the conductor terminal, a spring force of the spring lug acting upon the actuating element at least in a position of the actuating element between the initial position and the actuating position.

An actuating mechanism may thus be provided in a structurally simple manner, which makes it possible to transfer the actuating element into a locking position in the actuating position with the clamping point opened, independently of the spring force of the clamping spring. The spring lug is therefore an element or component independent of and separate from the clamping spring. Once the actuating head had been pushed into the area of the locking position, the actuating element is pivoted into the locking position by the spring force of the spring lug, the actuating element being locked in the locking position, and the clamping point thus being opened.

The elastically deflectable spring lug may be arranged, for example, in the area of the actuating channel or directly in the actuating channel, the spring force pressing the actuating element into the locking position once the actuating element has been pushed from the initial position into the actuating position. The elastically deflectable spring lug may thus, in particular, be an integral part of the insulating housing or be formed as a single piece with the insulating housing. However, it is also conceivable that the elastically deflectable spring lug is arranged as a separate part in the area of the actuating channel or directly in the actuating channel.

It is conceivable that the spring force of the spring lug tends toward zero in the actuating position when the actuating element is pivoted into the locking position to relieve the spring lug when the clamping point is opened and to thus reduce wear phenomena.

In at least a position of the actuating element between the initial position and the actuating position, a spring force of the spring lug acts upon the actuating element. The spring lug is elastically deflectable against its spring force in a position of the actuating element between the initial position and the actuating position.

The deflection of the actuating element into the locking position may take place independently of the spring force of the clamping leg. The actuating element is transferred into the locking position solely by the spring force of the spring lug. However, it is also conceivable that the spring force of the clamping leg supports the pivoting of the actuating element into the locking position in addition to the spring force of the spring lug.

In particular, a spring lug is not a tool slot, the actuating element being able to be transferred into a locking position by an engagement of a tool with the tool slot. The spring lug is provided with an elastic design, i.e., in particular, the spring lug may return to its original shape after the effect of a force.

The initial position is the position in which the actuating element is situated when the clamping point is completely closed. In this state, the spring lug may be completely relaxed, i.e., the spring lug does not undergo an elastic deformation. The actuating position is the position in which the actuating element is situated when the clamping point is completely opened. In the actuating position, the actuating element may be pivoted, according to the invention, into the locking position by the spring force of the spring lug.

In the actuating position, the actuating element may be pivotably supported in a locking recess of the insulating housing. The actuating element may thus be transferred in a structurally simple manner into the locking position by the spring force of the spring lug.

However, it is also conceivable that the locking recess is arranged on the actuating element, the actuating element being pivotable in the actuating position by the spring force of the spring lug in such a way that the locking recess on the actuating element is locked with with the insulating housing, and the actuating element is held in the locking position.

The elastically deflectable spring lug may be arranged on an actuating head, which is diametrically opposed to the actuating section, a spring force of the spring lug acting upon the actuating element at least in a position of the actuating element between the initial position and the actuating position.

It has been shown that the locking mechanism according to the invention may be easily provided in that the elastically deflectable spring lug is arranged on the actuating head of the actuating element. The spring lug may be formed, for example, as a single piece from the actuating element.

The actuating element may be arranged essentially in parallel to the conductor insertion direction, the actuating element being movably supported in the insulating housing in the actuating channel in parallel to the conductor insertion direction.

In this way, a conductor terminal may be provided, the actuating element interacting with the clamping leg in such a way that the actuating element does not project into the conductor insertion area and thus does not unintentionally come into contact with an inserted electrical conductor.

This essentially means, in particular, that the actuating element does not have to be arranged exactly in parallel to the conductor insertion opening. Essentially means, in particular, that minor deviations from an exact parallelism are possible. For example, it is conceivable that the arrangement of the actuating element deviates, for example, 5° or 10° (in a 360° system) from an exact parallelism.

The spring lug may protrude on the side of the actuating head facing the conductor insertion opening. The spring lug may further advantageously protrude from the actuating head in the direction of the conductor insertion opening.

During the actuation operation, i.e., the transfer of the actuating element from the initial position into the actuating position, the spring lug is deflected against its spring force, the actuating element being pivoted by the spring force into the locking recess once it has reached the area of the locking recess.

The locking recess may be arranged on the side of the actuating channel facing away from the conductor insertion opening.

By arranging the locking recess on the side of the actuating channel facing away from the conductor insertion opening, the structural conditions of the insulating house may be used to provide a compact conductor terminal.

An opening may be arranged in the insulating housing, the opening extending from an outside of the insulating housing to the actuating channel. In particular, the opening may extend from the outside of the insulating housing to the actuating channel essentially perpendicularly with respect to the actuating channel.

Due to the opening, the actuating element may be easily transferred from the actuating position back into the initial position in that, for example, the actuating element may be guided out of the locking recess by an actuating tool, the actuating element being able to be guided back into the initial position, for example, by the spring force of the clamping leg.

The opening is designed, for example, as a releasing or resetting channel for the actuating element, the actuating element being transferable into the actuating channel from the locking recess.

It is also conceivable that a releasing element is arranged in the opening, the releasing element being configured to release the actuating element from the locking position in the locking recess, i.e., to pivot it back into the actuating channel.

The opening may extend into the area of the locking recess.

In this way, the possibility of releasing the actuating element in the actuating position is further improved, since the actuating element may be pivoted directly out of the locking recess into the actuating channel, for example with the aid of a tool or a releasing element.

It is conceivable, for example, that the opening extends adjacent to the locking recess. The opening may thus be arranged between the area of the opening and a pivot point of the actuating element, the pivot point being the point around which the actuating element may be pivoted into the locking recess and back again.

The spring lug may protrude at an angle from the actuating head.

An angled design of the spring lug may take place independently of the conductor insertion opening. The angled spring lug is completely relaxed in the initial position, so that no spring force of the spring lug acts upon the actuating element. The spring lug rests against a chamfer of the insulating housing, which advantageously runs at an angle with respect to the direction of the actuating channel. If the actuating element is transferred into the actuating position, the spring lug is elastically deformed against its spring force, the spring force acting upon the actuating element, and the actuating element being pivoted into the actuating position by the spring force of the spring lug in the locking recess.

It is also conceivable that the conductor terminal has a plurality of spring lugs, for example two, three or four. It is further conceivable that the conductor terminal is designed as a multi-pole conductor terminal, for example, as a two-pole, three-pole or six-pole conductor terminal, each point being assigned at least one clamping point, which are each formed from a busbar and a clamping spring.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
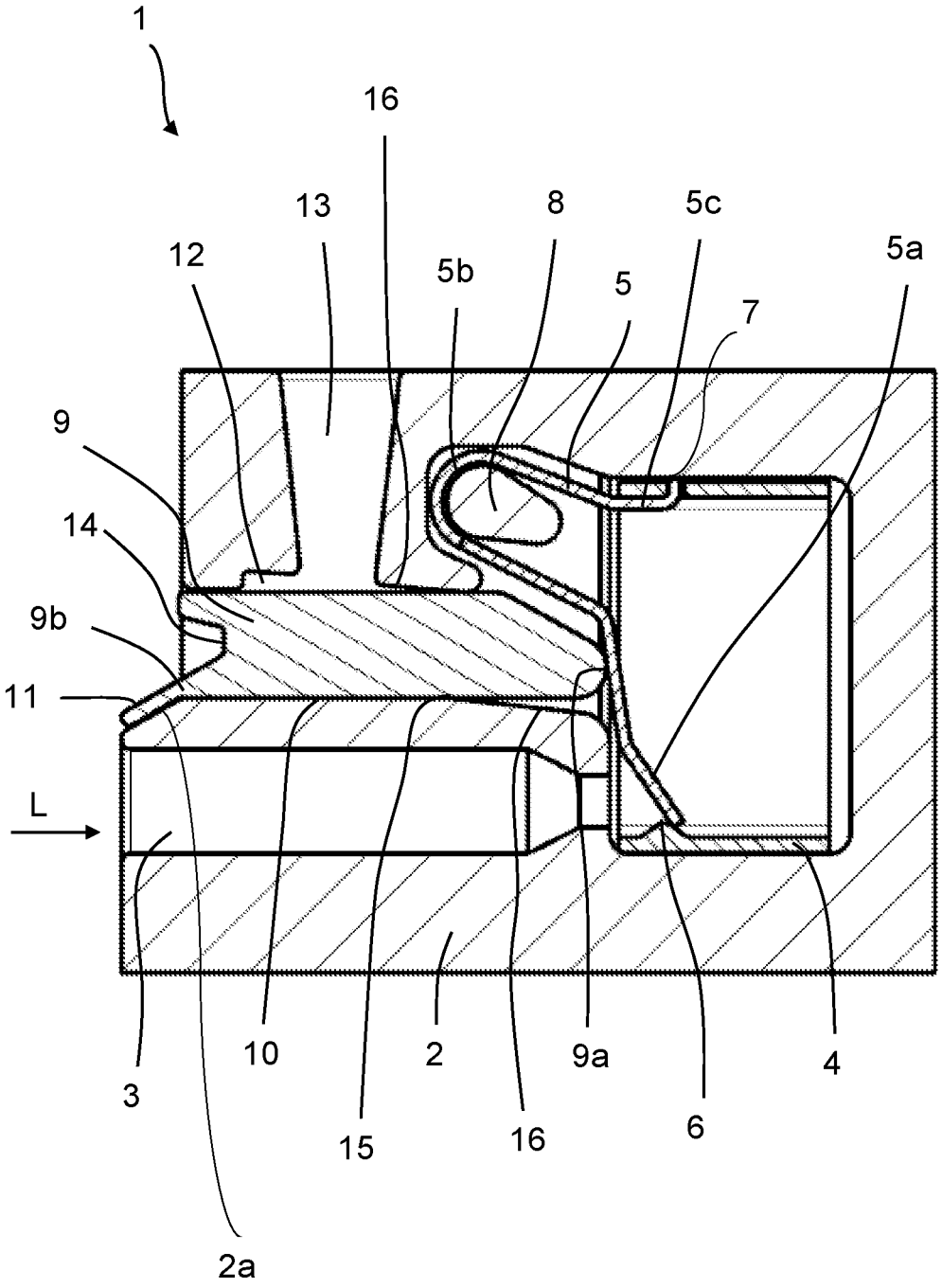
FIG. 1 shows a conductor terminal with an actuating element in an initial position.

FIG. 1 shows a conductor terminal 1 according to the invention in a first example, including an insulating housing 2. A conductor insertion opening 3 for inserting an electrical conductor in a conductor insertion direction L is arranged in insulating housing 2. A busbar 4 and a clamping spring 5 are arranged in insulating housing 2, clamping spring 5 having a clamping leg 5*a*, which, together with busbar 4, forms a clamping point 6 for the electrical conductor to be clamped.

It is further apparent that clamping leg 5*a* of clamping spring 5 transitions into a spring bend and subsequently extends into a contact leg 5*c*. Contact leg 5*c* is designed for contact with busbar 4. In the exemplary embodiment in FIG. 1, contact leg 5*c* adjoins busbar 4 opposite clamping point 6. Contact leg 5*c* engages with a recess 7 at busbar 4 by its free end, which is angled in this exemplary embodiment, so that clamping spring 5 is fixed in its position. Spring bend 5*b* is supported around a projection 8 protruding from insulating housing 2.

It is made clear that conductor terminal 1 has an actuating element 9, actuating element 9 being movably supported in an actuating channel 10 of insulating housing 2. Actuating element 9 has an actuating section 9*a* on a free end, actuating section 9*a* interacting with clamping leg 5*a* in such a way that clamping leg 5*a* is displaceably designed to open clamping point 6 upon a movement of actuating element 9 in the direction of clamping leg 5*a*. Actuating section 9*a* therefore transfers clamping leg 5*a* from a closed position of clamping point 6 to an opened position of clamping point 6, an electrical conductor being able to be inserted through conductor insertion opening 3 into conductor terminal 1 when clamping point 6 is opened.

FIG. 1 shows a conductor terminal 1, with an actuating element 9 in an initial position. The initial position is the position of actuating element 9, in which actuating element 9 is situated when clamping point 6 is completely closed.

Figure 2:
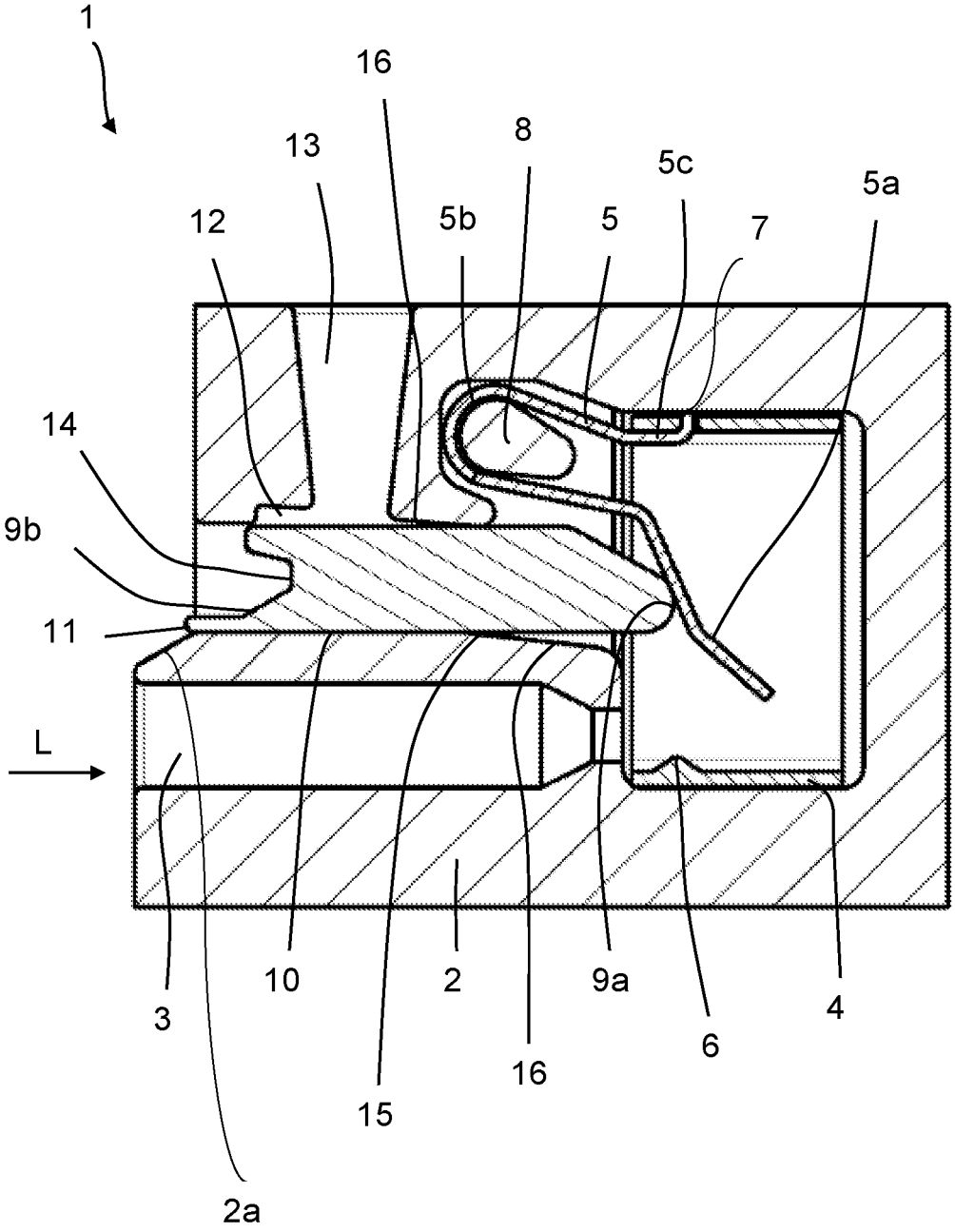
FIG. 2 shows a conductor terminal according to FIG. 1, with an actuating element between an initial position and an actuating position.
Figure 3:
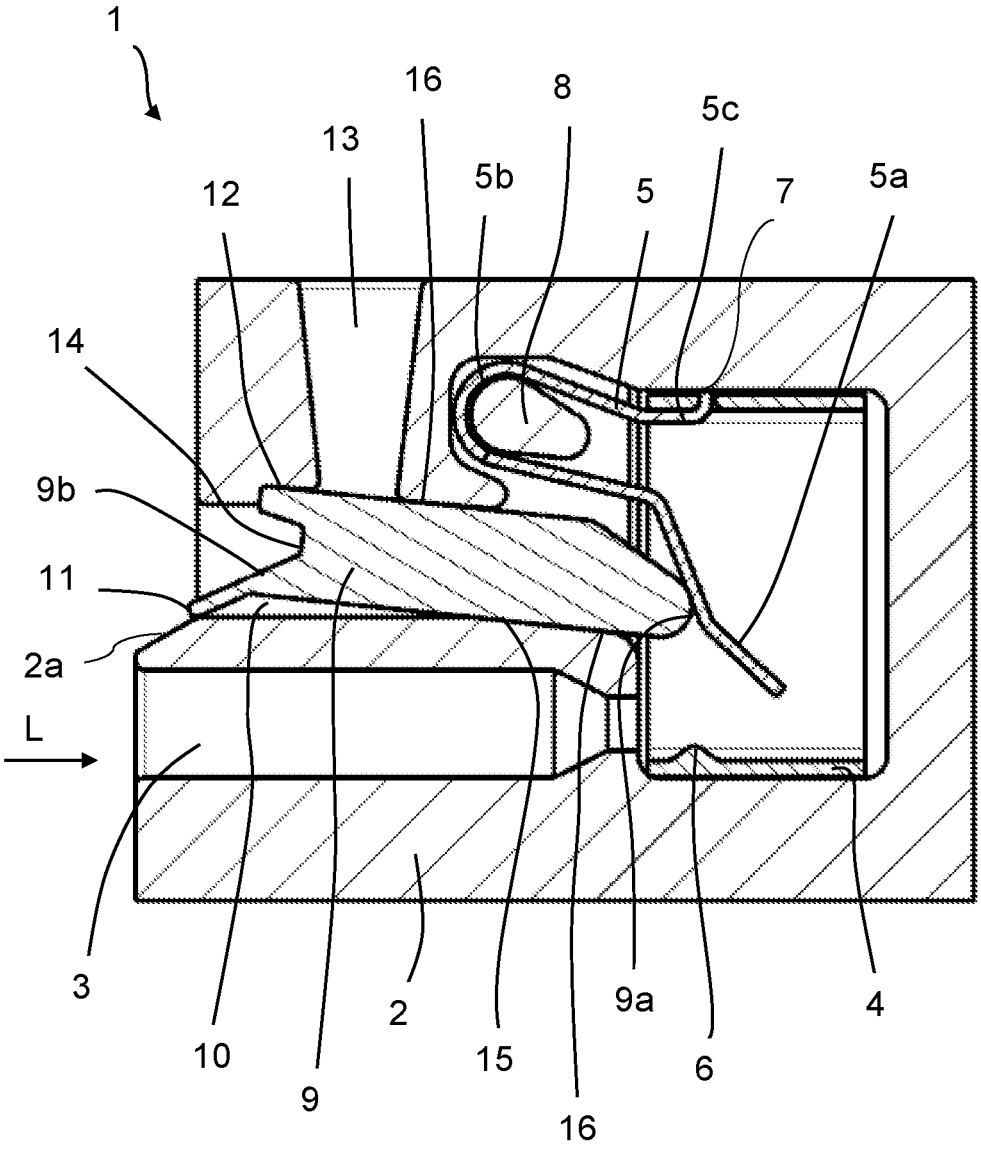
FIG. 3 shows a conductor terminal according to FIG. 1, with an actuating element in an actuating position.

FIGS. 2 and 3 show conductor terminal 1 according to FIG. 1 in a position which differs from that of the initial position. FIG. 3 shows actuating element 9 in an actuating position, the actuating position being the position of actuating element 9, in which actuating element 9 is situated when clamping point 6 is open. FIG. 2 shows actuating element 9 in a position between the initial position and the actuating position, clamping point 6 not yet been completely opened.

It is apparent from FIGS. 1 through 3 that an actuating head 9*b* is arranged on an end diametrically opposed to actuating section 9*a*, an elastically deflectable spring lug 11 of actuating element 9 protruding from actuating head 9*b*. In the initial position according to FIG. 1 and in the actuating position according to FIG. 3, it is made clear that spring lug 11 protrudes at an angle from actuating head 9*b*.

It is made clear that spring lug 11 protrudes in the direction of conductor insertion opening 3 in the initial position of actuating element 9, spring lug 11 protruding from actuating head 9*b* on the side facing conductor insertion opening 3. Spring lug 11 advantageously adjoins a slope 2*a* of insulating housing 2, slope 2*a* running at an angle from actuating channel 10 in the direction of conductor insertion opening 3. Slope 2*a* of insulating housing 2 is, in particular, an incline which differs from the incline of actuating channel 10.

It is further made clear that actuating channel 10 preferably runs predominantly in parallel to conductor insertion direction L, a locking recess 12 being arranged at actuating channel 10. Locking recess 12 is arranged on the side of actuating channel 10 facing away from the conductor insertion opening. If actuating element 9 is pushed from the initial position into the actuating position, spring lug 11 is elastically deflected against its spring force into at least a position of actuating element 9 between the initial position and the actuating position. A spring force is thus applied by spring lug 11 onto actuating element 9. If actuating element 9 is guided into the actuating position, actuating element 9 is thus pivoted into a locking position in locking recess 12 by the spring force or spring lug 11, actuating element 9 being locked in locking recess 12. Clamping leg 5*a* is thus held in the actuating position by actuating section 9*a* of actuating element 9 in such a way that clamping point 6 is opened. Due to spring lug 11, actuating element 9 may thus be transferred into the locking position without any further aids, such as a tool or the spring force of the clamping spring.

Due to its resilient deflection, spring lug 11 presses actuating element 9 into locking recess 12 once actuating head 9*b* reaches the area of locking recess 12 during the displacing movement. Actuating element 9 may be held or secured by spring lug 11 in locking recess 12, the holding or securing force of spring lug 11 being able to trend, in principle, toward zero in the actuating position. Spring lug 11 may thus again be completely relaxed in the actuating position of actuating element 9, i.e., the spring force of spring lug 11 trends toward zero.

It is further apparent that an opening 13 is arranged in insulating housing 2, opening 13 being designed as a releasing or resetting channel. Opening 13 extends essentially perpendicularly from an outside of insulating housing 2 to actuating channel 10, opening 13 extending into the area of locking recess 12. Opening 13 runs in a conical manner, i.e., the cross section of opening 13 tapers from the outside of insulating housing 2 in the direction of actuating channel 10.

Actuating element 9 may be easily released from being locked in locking recess 12 via an opening 13 designed as a releasing or resetting channel. This may take place, for example, with the aid of an actuating tool or via a separate releasing element, which is movably arranged in opening 13, the releasing element being configured to pivot actuating element 9 out of locking recess 12 into actuating channel 10. Actuating element 9 may thus be guided back into the initial position under the effect of the restoring force of clamping spring 5.

However, it is also conceivable that actuating element 9 may be pivoted out of locking recess 12 via a tool slot 14 on actuating head 9*b*. An actuating tool may be placed into tool slot 14 to pivot actuating element 9 out of locking recess 12.

It is made clear that opening 13 is arranged between the area of locking recess 12 and a pivot point 15 of actuating element 9, pivot point 15 being the point around which actuating element 9 may be pivoted into locking recess 12 and back again. If a releasing element or an actuating tool is placed on locked actuating element 9, actuating element 9 may be easily pivoted out of locking recess 12 around pivot point 15 by a sufficiently high force of the releasing element or the actuating tool onto actuating element 9.

To form pivot point 15, actuating channel 10 is designed in such a way that chamfers 16 are formed on the end of actuating channel 10 facing clamping spring 5. If actuating element 9 is transferred from the initial position into the actuating position, actuating element 9 is pivoted around pivot point 15 by the spring force of spring lug 11, so that it also adjoins chamfers 16 in the area of actuating section 9*a* in the locking position in locking recess 12.

Figure 4:
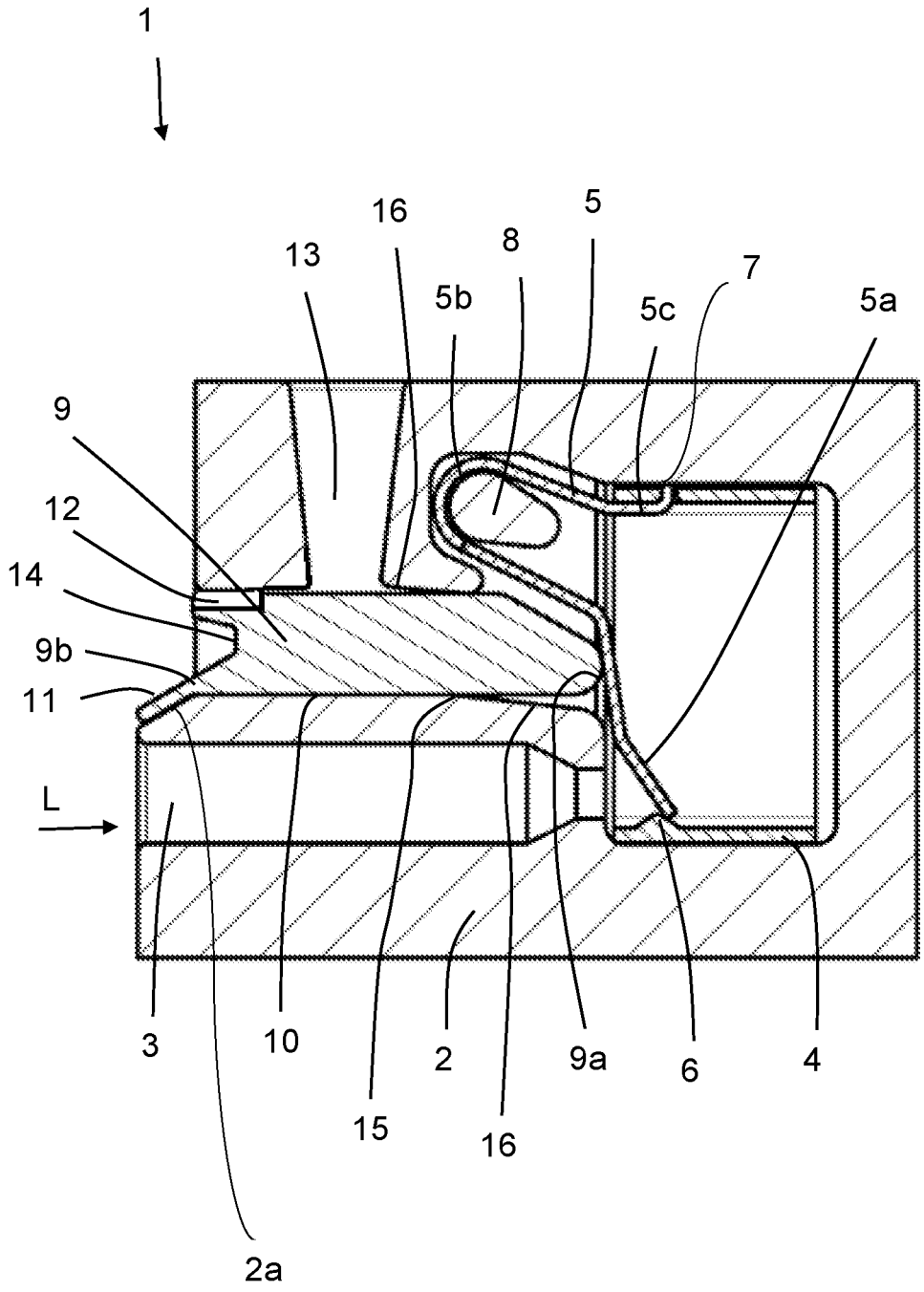
FIG. 4 shows a conductor terminal with an actuating element in an initial position.

FIG. 4 shows a conductor terminal 1 in a second specific embodiment, with an actuating element 9 in an initial position. It is made clear that locking recess 12 is arranged on actuating element 9, actuating element 9 being pivotable into the actuating position, i.e., when clamping point 6 is opened, by the spring force of spring lug 11 in such a way that locking recess 12 on actuating element 9 locks with insulating housing 2, and actuating element 9 is held in the locking position.

The example in FIG. 4 differs from FIGS. 1 through 3 only with respect to locking recess 12. In this regard, the designs of the first specific embodiment are transferable to the second specific embodiment.

Figure 5:
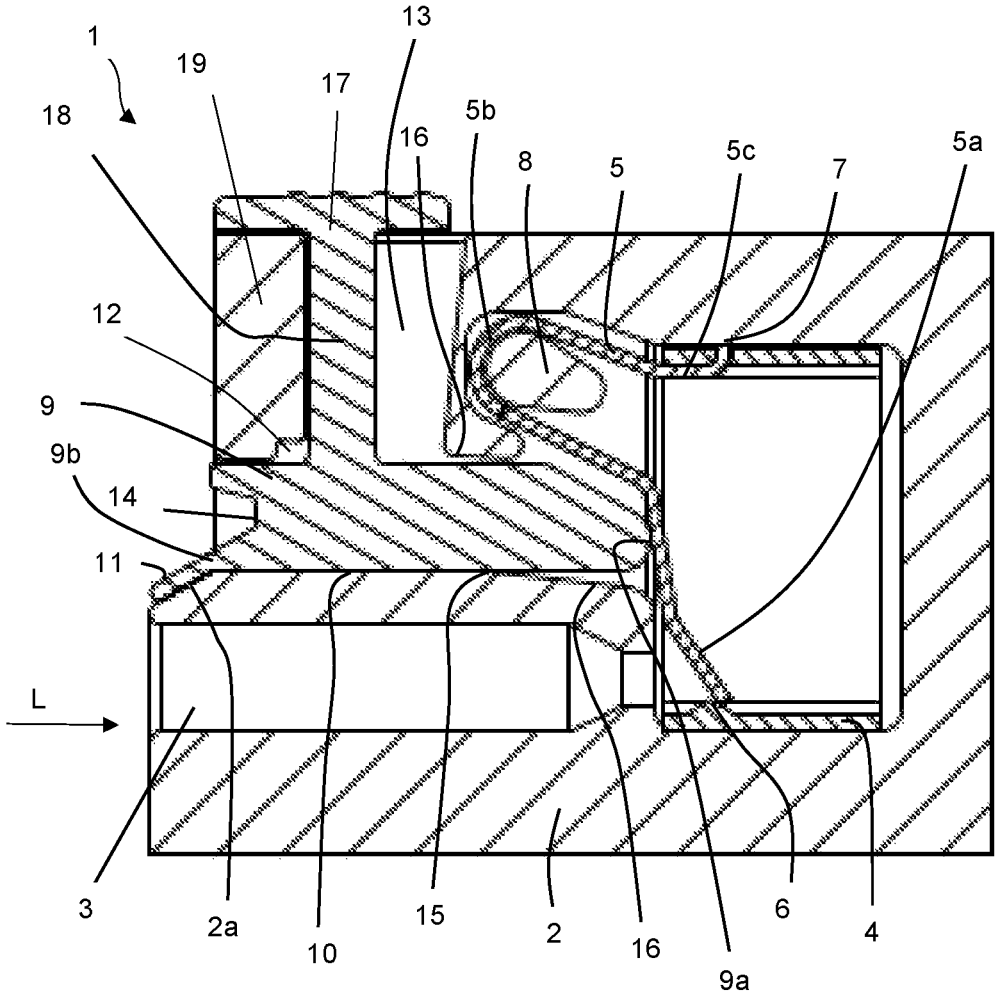
FIG. 5 shows a conductor terminal with an actuating element in an initial position; an FIG. 6 shows a conductor terminal according to FIG. 5, with an actuating element in an actuating position.
Figure 6:
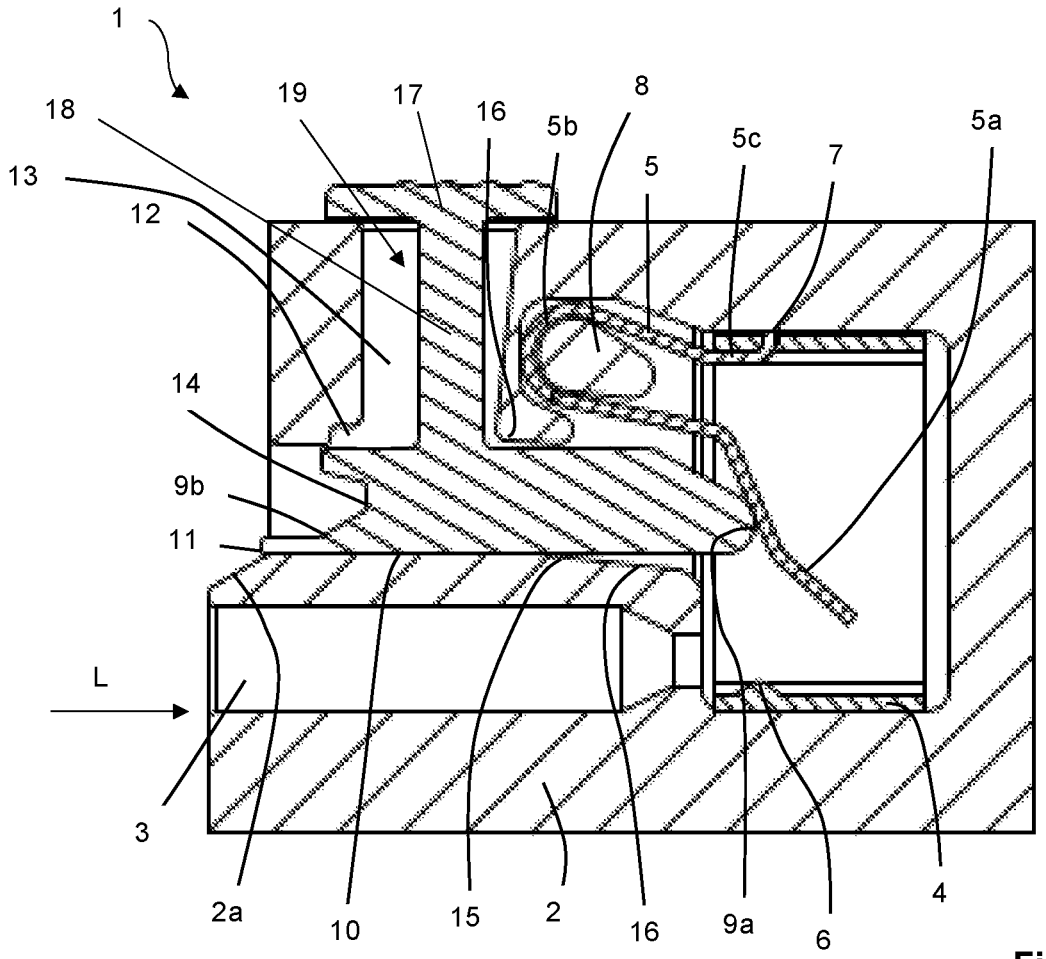

Based on FIGS. 5 and 6, an example of a conductor terminal 1 is explained, in which a releasing element 19 for releasing the locking of actuating element 9 is present in the area of opening 13. Releasing element 19 may be designed as a further component of conductor terminal 1 or as a separate releasing element. If releasing element 19 is designed as a component of conductor terminal 1, it is fixedly arranged there, so that it is always available for the user.

Releasing element 19 includes a gripping element 17, which is used for a manual actuation by the user and may protrude, for example, from insulating housing 2 or at least be exposed to the extent that it may be easily operated by the user, even if it is arranged within the space surrounded by insulating housing 2. Gripping element 17 is connected to actuating element 9 via a connecting section 18. Connecting section 18 extends through opening 13.

FIGS. 5 and 6 show an example, in which gripping element 17 is designed as a component forming a single piece with connecting section 18 and actuating element 9. However, gripping element 17 and/or connecting section 18 may also be designed as a separate component, which is coupled with the particular other component, for example via a form-fitting and/or force-fitting connection, e.g., with the aid of a locking connection.

FIG. 5 shows conductor terminal 1 in the initial position, i.e. without actuation of actuating element 9. With the exception of additional releasing element 19, this corresponds to the specific embodiment in FIG. 1. FIG. 6 shows the conductor terminal according to FIG. 5 in the actuating position. Actuating element 9 is locked in the actuating position. The locking may be released by manual actuation of gripping element 17. For example, if a pressure force is applied to gripping element 17, this force is transmitted via connecting section 18 to actuating element 9, so that the latter is pivoted downward again and may move back into the initial position, due to the restoring force of clamping spring 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

an insulating housing having a conductor insertion opening for inserting an electrical conductor in a conductor insertion direction;

a busbar;

a clamping spring having a clamping leg, which, together with the busbar, forms a clamping point for the electrical conductor;

an actuating element movably supported in an actuating channel in the insulating housing and having an actuating section interacting with the clamping leg such that the clamping leg is displaceably designed to open the clamping point during a movement of the actuating element in a direction of the clamping leg; and an elastically deflectable spring lug arranged on the conductor terminal, a spring force of the spring lug acting upon the actuating element at least in a position of the actuating element between the initial position and the actuating position wherein the actuating element is transferable from an initial position into an actuating position, wherein the clamping point is opened in the actuating position, wherein the actuating element is pivotably supported in a locking position in the actuating position, and wherein the actuating element is lockable in the locking position.

2. The conductor terminal according to claim 1, wherein, in the actuating position, the actuating element is pivotably supported in an locking recess of the insulating housing.

3. The conductor terminal according to claim 1, wherein the elastically deflectable spring lug is arranged on an actuating head which is situated diametrically opposed to the actuating section, wherein a spring force of the spring lug acts upon the actuating element at least in a position of the actuating element between the initial position and the actuating position.

4. The conductor terminal according to claim 1, wherein the actuating element is arranged essentially in parallel to the conductor insertion direction, and wherein the actuating element is movably supported in the insulating housing in the actuating channel in parallel to the conductor insertion direction.

5. The conductor terminal according to claim 4, wherein the spring lug protrudes on a side of the actuating head facing the conductor insertion opening.

6. The conductor terminal according to claim 4, wherein the spring lug protrudes from the actuating head in a direction of the conductor insertion opening.

7. The conductor terminal according to claim 4, wherein the locking recess is arranged on the side of the actuating channel facing away from the conductor insertion opening.

8. The conductor terminal according to claim 1, wherein an opening is arranged in the insulating housing, the opening extending from an outside of the insulating housing to the actuating channel.

9. The conductor terminal according to claim 8, wherein the opening extends essentially perpendicularly from the outside of the insulating housing to the actuating channel.

10. The conductor terminal according to claim 8, wherein the opening extends into the area of the locking recess.

11. The conductor terminal according to claim 8, wherein the conductor terminal has a releasing element, via which the locking of the actuating element is adapted to be released in the actuating position.

12. The conductor terminal according to claim 11, wherein at least one portion of the releasing element extends through the opening.

13. The conductor terminal according to claim 1, wherein the spring lug protrudes at an angle from the actuating head.

* * * * *